United States Patent [19]

Barna

[11] 4,353,346

[45] Oct. 12, 1982

[54] COMPOUND BOW

[76] Inventor: Alex J. Barna, 1216 Crawford St., Dunquesne, Pa. 15110

[21] Appl. No.: 148,208

[22] Filed: May 9, 1980

Related U.S. Application Data

[63] Continuation of Ser. No. 921,314, Jul. 3, 1978, Pat. No. 4,202,316.

[51] Int. Cl.[3] ..... E41B 5/00

[52] U.S. Cl. ..... 124/24 R; 124/90

[58] Field of Search ..... 124/23 R, 24 R, 41 A, 124/35 A, 86, 90, DIG. 1; 474/154, 203, 211

[56] References Cited

U.S. PATENT DOCUMENTS

| | | | |
|---|---|---|---|
| 2,227,645 | 1/1941 | Hayden | 124/90 X |
| 3,486,495 | 12/1969 | Allen | 124/24 R |
| 3,967,609 | 7/1976 | Frydenlund | 124/24 R |
| 4,214,488 | 7/1980 | Conrad | 474/154 |

*Primary Examiner*—Richard C. Pinkham
*Assistant Examiner*—William R. Browne
*Attorney, Agent, or Firm*—Stanley J. Price, Jr.; John M. Adams

[57] ABSTRACT

A compound bow includes a pair of limbs that extend from opposite end portions of a handle member. Each limb has a free end portion which is rotatably and eccentrically mounted on a pulley. A continuous cable is reeved about the pulleys and extends between the free end portions of the limbs. The portion of the cable reeved about the pulleys includes devices for engaging sprockets of the pulleys in a manner to permit adjustments in the draw length and draw weight of the cable. A flexible portion of the cable extends between the pulleys and is arranged to receive the arrow. A rigid portion of the cable includes a pair of overlying rigid sections each extending from a respective pulley to the free end portion of the opposite limb. The flexible and rigid cable portions are aligned with the longitudinal axis of the bow to eliminate torque to the limbs at all times. The rigid cable portion is preferably fabricated of wire material to permit the intermediate portion of each section of the rigid portion to be bent laterally from the longitudinal axis of the bow. The bent intermediate portions are thus positioned in overlying relation and deflected laterally to prevent contact between the rigid cable portion and the arrow when the arrow is released from the bow.

22 Claims, 8 Drawing Figures

COMPOUND BOW

CROSS REFERENCE TO RELATED APPLICATIONS

This application is a continuation of copending application Ser. No. 921,314 filed on July 3, 1978, entitled "Compound Bow" by Alex J. Barna and now U.S. Pat. No. 4,202,316.

BACKGROUND OF THE INVENTION

1. Field of the Invention

This invention relates to a compound bow and more particularly to a compound bow having a continuous cable which is reeved about pulleys eccentrically positioned on the limbs of the bow and is adjustable to vary the draw tension and draw length of the cable which is aligned with the longitudinal axis of the bow to eliminate torque on the limbs at all times.

2. Description of the Prior Art

Compound bows, as well known in the art, utilize eccentrically positioned bow string or cable mounting devices secured to the free ends of the bow limbs. The cable or arrow string is reeved around the eccentric devices which include wheels, pulleys and the like and are operable to provide a mechanical advantage to increase the amount of potential energy stored in the limbs as the arrow string is drawn. With this arrangement when the arrow string is in the full draw position, maximum potential energy is stored in the bow, but the force required to maintain the arrow string in the full draw position is less than the maximum draw weight of the bow. As the bow string is being drawn the draw weight or force applied to the bow increases to a maximum draw weight and lets off to a lower draw weight at the full draw position. Maximum energy is stored in the limbs without requiring maximum force to be applied to the arrow string to hold the arrow string at the full draw position. This substantially improves the performance of the bow and ease of operation.

Examples of compound bows utilizing eccentric pulleys are disclosed in the following U.S. Pat. Nos.: 3,486,495; 3,958,551; 4,054,118; 4,061,124 and 4,064,862. However, a problem is encountered with mounting the cable upon the eccentric pulleys in a manner to prevent contact between the cable and a released arrow's fletching so as not to interfere with the flight of the arrow or damage the arrow fletching. Therefore, suitable devices such as auxiliary cable adjustment deflectors, such as pulleys, illustrated in U.S. Pat. No. 4,054,118 have been utilized to deflect the cable from the sight window where the arrow is mounted on the bow. With this arrangement the cable will not contact the arrow when the arrow is released from the bow. A channeled cable deflector sold by Trueflight Manufacturing Co., Inc. is operable when clamped onto the portion of the cable opposite the arrow shaft to remove the cable from contact with the arrow shaft.

However, moving the tension cable out of the path of a released arrow by reeving the cable around additional pulleys to deflect the cable from the longitudinal axis of the bow and remove the cable from alignment with the longitudinal axis of the bow exerts a torque upon the limbs of the bow. This introduces stress upon the limbs which after a period of time may damage the limbs and/or substantially reduce the consistency and accuracy to be obtained by the bow. Therefore, there is need to provide in a compound bow apparatus for mounting the cable on the pulleys in a manner which removes the cable from contact with the fletching of a released arrow without subjecting the limbs of the bow to a torque and furthermore by an arrangement which permits adjustments in the draw tension of the cable.

SUMMARY OF THE INVENTION

In accordance with the present invention there is provided a compound bow for propelling an arrow that includes a handle member for gripping the bow. A first limb and a second limb are connected to opposite ends of the handle member and are operable to store energy to propel the arrow. The first and second limbs and the handle member have a longitudinal axis extending the length of the bow. A first pulley and a second pulley are provided. A first mounting assembly rotatably and eccentrically positions the first pulley on the free end portion of the first limb. A second mounting assembly rotatably and eccentrically positions the second pulley on the free end portion of the second limb. A continuous cable is provided for flexing the first and second limbs. The continuous cable has a first end portion attached to the first mounting assembly and a second end portion attached to the second mounting assembly. The continuous cable includes a flexible portion and a rigid portion. The flexible portion is reeved about the first and second pulleys and extends therebetween to receive the arrow. The flexible and rigid portions are aligned with the longitudinal axis. The rigid portion includes a pair of overlying rigid sections. The pair of overlying rigid sections each has an intermediate portion that is deflected laterally from the longitudinal axis to prevent contact between the continuous cable rigid portion and the arrow when the arrow is released from the bow. Each of the pair of overlying rigid sections has a first end portion connected to an end of the flexible portion that is reeved about the respective pulley and a second end portion that is connected to one of the respective mounting assemblies on the free end of a corresponding limb. The first and second end portions of each rigid section are aligned with the longitudinal axis that extends the length of the bow. The intermediate portion of each rigid section extends between the respective first and second end portions. The intermediate portion is preferably fabricated of wire material which is bent out of alignment with the longitudinal axis to thereby provide clearance for the arrow when released from the continuous cable flexible portion so that the arrow will not contact the continuous cable rigid portion. With this arrangement the arrow is not misdirected from its intended flight, and the arrow fletching is not damaged by contact with the rigid portion.

In a preferred embodiment of the present invention the intermediate portion of each of the pair of overlying rigid sections includes a first linear section that is connected to and extends at an angle from the first end portion of the respective rigid section and a second linear section that is connected to and extends at an angle from the second end portion of the respective rigid section. A third linear section connects the first and second linear sections. The third linear section is positioned in spaced lateral parallel relation to the first and second end portions of the respective rigid section. This arrangement provides sufficient deflection of the pair of overlying rigid sections to prevent contact of the arrow therewith. However, the remaining portions of the continuous cable are aligned with the longitudinal axis of the bow. With this arrangement the forces applied to the limbs at all times are balanced so that no torque is applied to the limbs about the longitudinal axis of the bow. In this manner the accuracy of the bow is substantially improved.

An additional feature of the present feature includes a device for adjusting the draw weight and draw length in the flexible portion of the continuous cable which receives the arrow by engaging the portions of the cable reeved about the first and second pulleys. This is accomplished by providing opposite ends of the flexible cable portion with means for engaging the first and second pulleys in a manner to effect a change in the length of the flexible cable portion that extends between the first and second pulleys. By changing the length of the flexible cable portion, the draw weight and draw length of the bow is adjustable. The first and second pulleys each have an arrangement for receiving the flexible portions of the cable reeved therearound to maintain a preselected length of the flexible portion between the first and second pulleys.

Preferably the first and second pulleys each include sprockets on the outer circumference thereof. A plurality of abutment devices, such as beads, are secured in spaced relation to the flexible portions of the cable that are reeved about the first and second pulleys. The beads are equally spaced from one another to engage adjacent sprockets and prevent the cable from slipping on the respective pulley as the cable is being drawn.

A change in the length of the flexible cable portion between the first and second pulleys is effected by advancing or retracting each bead on the circumference of the pulley from a position between one pair of sprockets to a position between another pair of sprockets and thereby increase or decrease the tension of the flexible cable portion. Increasing the length of the flexible cable portion increases the tension therein. Accordingly, decreasing the length of the flexible cable portion decreases the tension therein.

A further feature of the present invention includes the first and second mounting assemblies which are operable to expediently position the first and second pulleys on the free ends of the limbs and engage the end portions of the rigid portions of the cable. This arrangement substantially reduces the time and effort required to make a change in the size of the pulleys on the limbs. The mounting assemblies each include a novel harness bracket that is connected to an end portion of one of the respective overlying rigid sections. The harness bracket is secured to a mounting bracket extending from the free end portion of a limb and releasably supports a pulley. The pulley is rotatably positioned on an axle that extends through aligned bores of the mounting bracket, harness bracket and pulley.

Accordingly, the principal object of the present invention is to provide a compound bow for propelling an arrow in which the cable portions are aligned with the longitudinal axis of the bow and includes portions which are bent in a manner to prevent the cable portions from contacting the arrow when the arrow is released from the bow.

Another object of the present invention is to provide a balanced compound bow having a cable that is mounted in alignment with the longitudinal axis of the bow and includes means for maintaining the cable displaced from the path of the arrow when it is released from the bow without additional apparatus mounted on the bow which reduces the performance of the bow and applies a torque to the bow.

A further object of the present invention is to provide a compound bow having a device for adjusting the length of the cable that is drawn to release the arrow to thereby adjust the draw weight and draw length.

These and other objects of the present invention will be more completely disclosed and described in the following specification, the accompanying drawings and the appended claims.

DESCRIPTION OF THE PREFERRED EMBODIMENT

Figure 1:
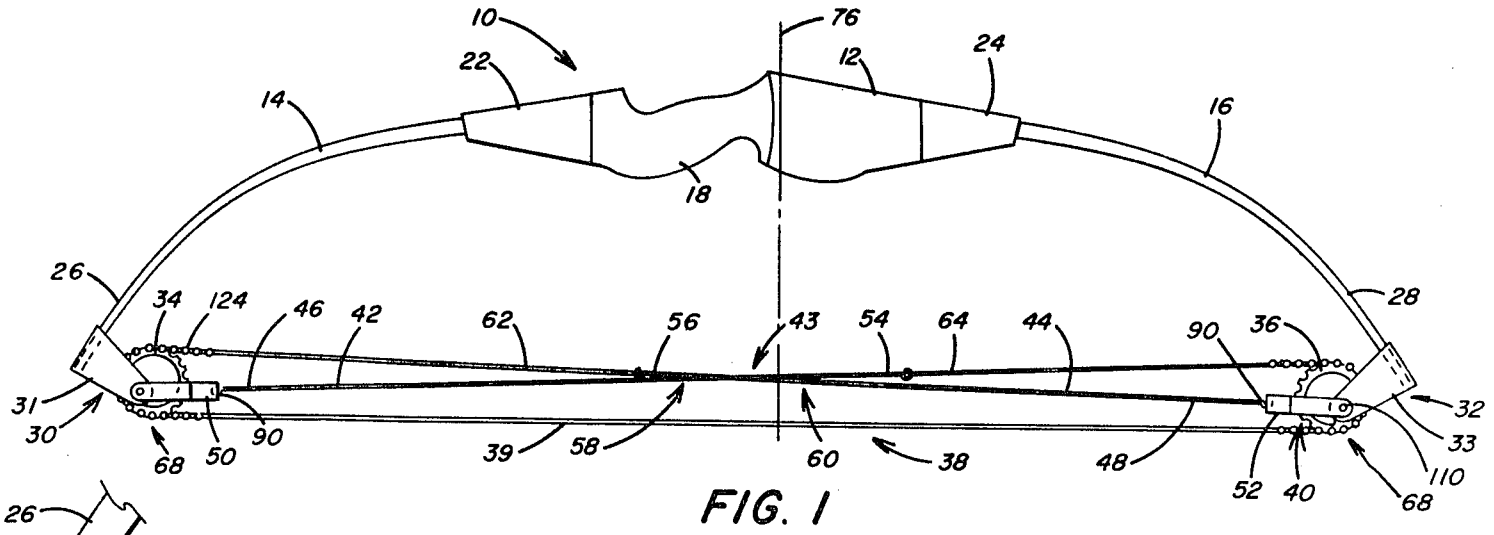
FIG. 1 is a view in side elevation of a compound bow, illustrating a continuous cable that is reeved about pulleys eccentrically mounted on the limbs of the bow and engages sprockets of the pulleys in a manner to adjust the length of the portion of cable extending between the pulleys with portions of the cable bent to provide clearance for the arrow.
Figure 2:
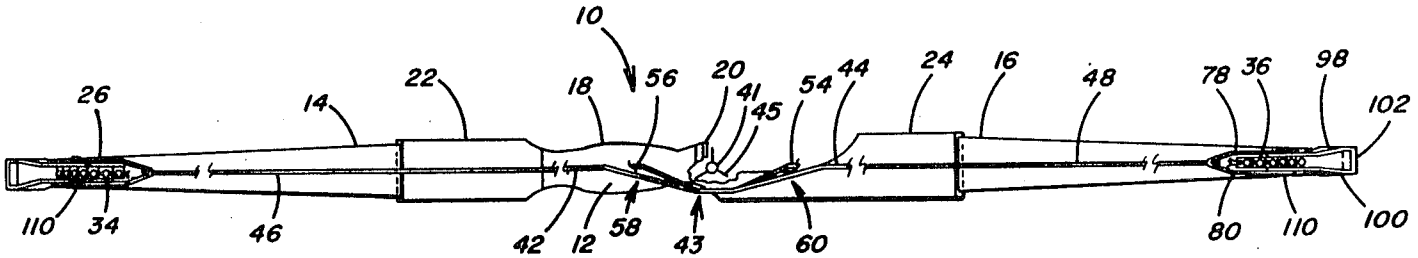
FIG. 2 is a fragmentary plan view of the compound bow shown in FIG. 1, illustrating the bent portions of the cable laterally deflected from the arrow.

Referring to the drawings and particularly to FIGS. 1 and 2, there is illustrated a compound bow generally designated by numeral 10 having a handle member 12 and a pair of limbs 14 and 16. The handle member 12 includes a grip portion 18 and a sight window 20. The handle member 12 also includes opposite end portions 22 and 24. The limbs 14 and 16 are connected at one end to the handle member end portions 22 and 24 respectively in a manner to permit the limbs 14 and 16 to pivot about their connections to the handle member 12. This arrangement permits adjustments in the flexure of the limbs. Suitable adjustable devices (not shown), such as disclosed in U.S. Pat. No. 4,061,124 which is incorporated herein by reference, may be utilized to pivotally connect the ends of the limbs to the handle member end portions 22 and 24. With such devices the limbs 14 and 16 are pivoted about the handle member end portions 22 and 24 so that free end portions 26 and 28 of the limbs may be either moved further apart or closer together to vary the draw tension in the limbs. The adjustable devices are beyond the scope of the present invention and will not be described in detail.

A pair of pulley and cable mounting assemblies generally designated by the numerals 30 and 32 are secured to the limb free end portions 26 and 28. The mounting assemblies 30 and 32 include brackets 31 and 33 respectively which are rigidly secured to the limb free end portions 26 and 28 and are operable to rotatably and eccentrically support a pair of pulleys 34 and 36. Devices generally designated by numeral 40 are provided on the pulleys 34 and 36 for engaging the portions of the cable 38 reeved about the pulleys in a manner to permit adjustments in the draw tension of the cable 38, as will be explained hereinafter in greater detail.

The continuous cable 38 includes a flexible portion 39 for receiving an arrow 41 and a rigid portion 43 which includes a pair of substantially rigid, non-flexible overlying cable sections 42 and 44. The rigid cable sections 42 and 44 have end portions 46 and 48 respectively that are connected by harness brackets 50 and 52 to the respective mounting assemblies 30 and 32. Each of the cable sections 42 and 44 include second end portions 54 and 56 respectively and intermediate portions 58 and 60 extending between the respective end portions 46, 54 and 48, 56. The intermediate portions 58 and 60 are bent in a configuration deflected laterally from the longitudinal axis of the bow so that the overlying cable sections 42 and 44 are removed from contact with the arrow so as not to interfere with the arrow fletching 45 when released from the bow. With this arrangement the respective end portions of the cable sections 42 and 44 are positioned in alignment with the longitudinal axis of the bow and the intermediate portions 58 and 60 are deflected laterally from the longitudinal axis or more specifically laterally from the sight window 20 of the handle member 12.

Figure 4:
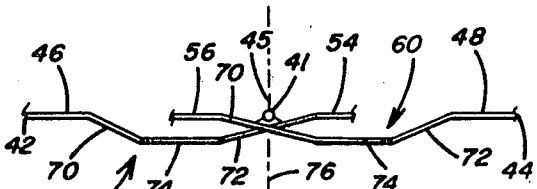
FIG. 4 is an enlarged fragmentary plan view of the bent portions of the cable, illustrating the position of the arrow fletching which is spaced from the bent portions when the cable is fully drawn.
Figure 3:
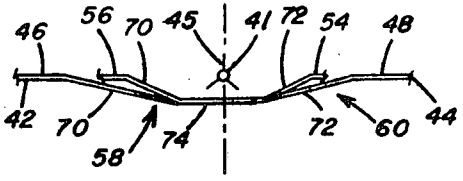
FIG. 3 is an enlarged fragmentary plan view of the bent portions of the cable, illustrating the position of the bent portions with respect to the arrow when the cable is in an undrawn position.

In a preferred embodiment of the present invention the rigid cable sections 42 and 44 are fabricated of steel wire or any other substantially rigid material which can be deformed to retain the configuration as illustrated in FIGS. 3 and 4. The respective rigid cable end portions 54 and 56 are suitably connected to ends 64 and 62 of the flexible cable portion 39 which is reeved about the pulleys 34 and 36. The section of the cable portion 39 that extends between the pulleys is arranged to receive the end of the arrow. The cable portion 39 includes devices generally designated by the numeral 68 that are operatively associated with the cable engaging devices 40 of each of the pulleys 34 and 36 to vary the length of the section of the cable portion 39 that extends between the pulleys 34 and 36. In this manner the draw length of the flexible cable portion 39 is adjusted by moving the limb free end portions 26 and 28 toward or away from each other. This adjustment also changes the draw weight of the bow.

As illustrated in FIG. 2, the first and second end portions 46, 54 and 48, 56 of the rigid cable sections 42 and 44 respectively are positioned in a plane that is aligned with the longitudinal axis of the bow. Furthermore, the cable end portions 46, 54 and 48, 56 are aligned with the flexible cable portion 39, which is shown broken away in FIG. 2. As described above, the first end portions 46 and 48 of the respective rigid sections 42 and 44 are connected to the opposite second end portions 54 and 56 by the intermediate portions generally designated by the numerals 58 and 60. The rigid intermediate portions are deflected or displaced laterally from alignment with the respective cable end portions and the sight window 20 so as not to interfere with the flight of the arrow 41 when it is released from the bow.

The cable intermediate portions 58 and 60, as illustrated in FIGS. 2 and 3, are positioned closer together in overlying relation when the flexible cable portion 39 is undrawn than when the flexible cable portion 39 is drawn, as illustrated in FIG. 4. In the drawn position of the flexible cable portion 39, the rigid intermediate portions 58 and 60 move away from each other as illustrated in FIG. 4. Each of the rigid intermediate portions includes a first linear section 70 connected to the respective end portions 46 and 56 and a second linear section 70 connected to the opposite respective end portions 54 and 48. The first and second linear sections 70 and 72 extend at an angle from the respective cable end portions, which angle is preferably an obtuse angle relative to the longitudinal axis of the bow. A third linear section 74 of each of the intermediate portions is connected to the first and second linear portions 70 and 72. The third linear section 74 is positioned in spaced lateral relation and parallel to the cable end portions 46–56 and 48–56.

As illustrated in FIG. 3, when the bow is in the undrawn position the third linear sections 74 are positioned in substantially overlying relation and centered with respect to a transverse axis 76 that extends through the handle member 12 and the sight window 20. In the drawn position, as illustrated in FIG. 4, the third linear sections 74 move laterally away from one another as the cable portion 39 is flexed. In the undrawn position, as illustrated in FIG. 3, the third linear sections 74 are removed from contact with the arrow and the arrow fletching and therefore do not interfere with the arrow. In the drawn position, however, the length of cable portion 39 is increased and to compensate for the flexing of the cable portion 39, the cable sections 42 and 44 are displaced and the third linear sections 74 move out of overlying relation.

In the drawn position of the bow the arrow fletching is positioned substantially rearwardly of the cable intermediate portions 58 and 60. When the flexible portion 39 of the cable 38 is released to propel the arrow, the bent intermediate portions 58 and 60 move from the position illustrated in FIG. 4 to the position illustrated in FIG. 3 before the arrow fletching passes the bent intermediate portions. Thus when the arrow fletching passes the bent intermediate portions 58 and 60, the bent intermediate portions have returned to their initial position where they are removed from the path of the arrow fletching. With this arrangement the rigid cable portion 43 is removed from contact with the arrow without the need for auxiliary deflectors mounted on the bow which apply a torque to the bow and adversely affect the accuracy of the bow.

The cable end portions 46 and 48 of the cable portion 43 are connected to the respective mounting brackets 31 and 33 by the harness brackets 50 and 52. As illustrated in greater detail in FIGS. 5 and 6 each harness bracket includes a bifurcated portion that is formed by a pair of arm members 78 and 80 that are spaced from one another at a first end 82 and connected to one another at a second end 84. The second end 84 includes a pair of oppositely positioned vertically aligned slots 86 and 88. The slots 86 and 88 are arranged to receive the respective cable end portions 46 and 48 by engagement of hooks 90 in the slots 86 and 88.

The first end 82 of each harness bracket arm member 78 and 80 includes a bore 92. The bores 92 are axially aligned and include an enlarged diameter portion 94 and a reduced diameter portion 96. The bifurcated portion of the harness brackets 50 and 52 are positioned in surrounding relation with the mounting brackets 31 and 33. The mounting brackets 31 and 33 each include spaced apart flanged portions 98 and 100 connected by a body portion 102 which is suitably secured to the free end portions 26 and 28 of the limbs 14 and 16. The end portions of the flanges 98 and 100 include aligned bores which in the assembled bow are positioned in underlying relation with the bores 92 extending through the harness bracket arms 78 and 80. Positioned between the mounting bracket flanges 98 and 100 are the respective pulleys 34 and 36.

Figure 6:
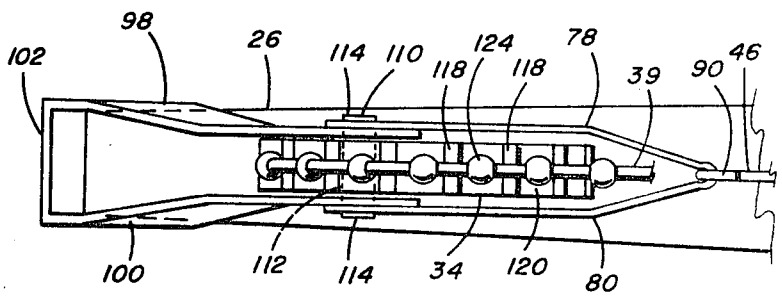
FIG. 6 is a plan view of the mounting assembly illustrating in FIG. 5.
Figure 5:
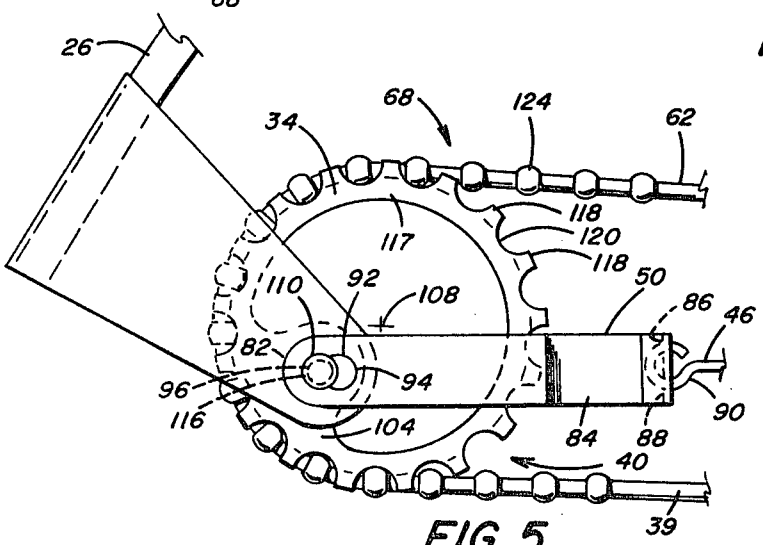
FIG. 5 is an enlarged fragmentary view in side elevation of a mounting assembly for connecting an end of the cable and a pulley on the free end of a limb, illustrating beads on the cable reeved about the pulley to engage the pulley in a manner to permit adjustments in the draw tension.
Figure 7:
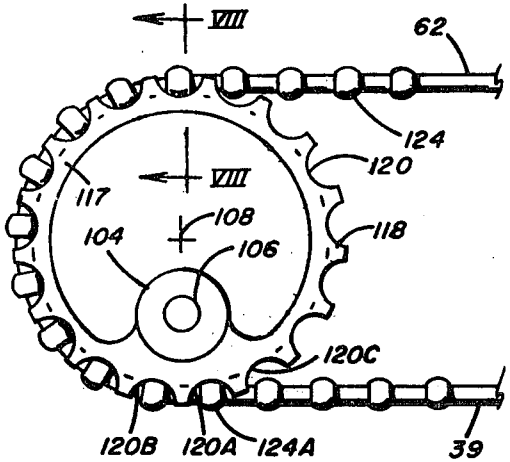
FIG. 7 is a view in side elevation of a pulley, illustrating sprockets of the pulley engaging beads secured to the portion of the cable reeved about the pulley.

Each of the pulleys 34 and 36, as illustrated in detail in FIGS. 5–7, includes a body portion 104 through which extends an eccentrically positioned bore 106 that is off-set from the geometric center 108 of each pulley. The pulleys 34 and 36 are positioned between the flanges 98 and 100 of the mounting brackets 31 and 33 so that the bores of the flanges 98 and 100 are aligned with the eccentric bore 106 of the respective pulleys. The harness bracket arm members 78 and 80 are positioned so that the arm member bores 92 are aligned with the respective bore 106 and the mounting bracket bores.

The respective members are maintained in assembled relation by an axle 110 which extends through the aligned bores and rotatably supports the pulleys 34 and 36 on the respective mounting brackets 31 and 33. The axle 110, as shown in FIGS. 5 and 6, includes a shaft portion 112 that is positioned in the bore 106 of each pulley. End portions 114 are spaced from the shaft portion 112 by a circumferential groove 116 that is arranged to receive the edge of the harness bracket arms 78 and 80 surrounding the bores 92.

In assemblying the pulleys 34 and 36 and harness brackets 50 and 52 on the mounting brackets 31 and 33, the bores thereof are initially aligned with the enlarged diameter portions 94 of harness bracket bores 92. The enlarged diameter portion 94 is arranged to freely receive the axle 110. Due to tension exerted upon the harness brackets by the cable sections 42 and 44, the tension must be resisted to align the enlarged diameter portions 94 of the bracket bores 92 with the aligned bores of the pulleys 34 and 36 and mounting brackets 31 and 33 to permit installation of the axles 110 therein.

Once the axles 110 are positioned in the aligned bores, the tension exerted upon the harness brackets 50 and 52 maintains the reduced diameter portions 96 of the bores 92 in surrounding relation with the axle 110. The diameter of the axles 110 is greater than the reduced diameter portions 96. Thus with the grooves 116 receiving the edge of the harness brackets surrounding the reduced portions 96, the axles are prevented from sliding through the bores 92. In this manner the mounting brackets, harness brackets and pulleys are retained in assembled relation on the free ends of the limbs without the need of conventionally known clips, snap rings and the like which increase the difficulty of replacing a pulley on the limbs of the bow.

Figure 8:
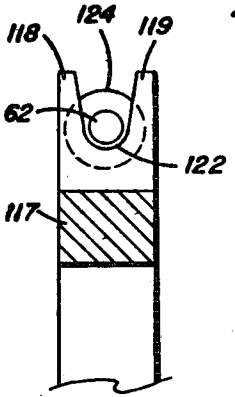
FIG. 8 is a fragmentary sectional view taken along line VIII—VIII of FIG. 7, illustrating the engagement of a bead of the cable with the pulley.

As illustrated in greater detail in FIGS. 7 and 8, each pulley 34 and 36 includes a rim portion 117 having an outer peripheral edge of sprockets a first set of sprocket teeth 118 and a second set of sprocket teeth 119. The sprocket teeth of each set are oppositely aligned and spaced apart by an annular groove 122. The sprocket teeth of each set are equally spaced from one another on the periphery of the rim 117 with roots 120 separating the adjacent teeth of each set. The draw weight and draw length adjustment devices 68 on the flexible cable portion 39 are arranged to be received in the roots 120 in abutting relation with the side edges of adjacent teeth. The flexible cable portion 39 is positioned in the annular groove 122. Thus the flexible cable portion 39 is engaged to the pulleys 34 and 36 and a preselected tension is exerted thereon.

The tension in the cable 38 is determined by the length of the cable portion 39 extending between the pulleys and accordingly determines the draw weight of the bow 10. Preferably, the adjustment devices 68 include a plurality of beads 124 or any other suitable abutment-type device secured in spaced relation on the portions of the cable portion 39 that is reeved around the pulleys 34 and 36. A preselected length of the cable portion 39 may be chosen to extend between the pulleys to provide a preselected draw tension in the cable 39 by engagement of the beads 124 with the sprocket teeth 118 and 119.

For example as illustrated in FIG. 7, the limbs 14 and 16 are flexed to urge the end portions 26 and 28 closer together beads 124 are advanced in a preselected direction, for example in a clockwise direction around the pulley so that a bead 124A is moved from root 120A to 120B. The corresponding change is made on the other pulley to effect a change in the length of the cable portion 39 extending between the limb end portions 26 and 28 and the tension in the cable portion. Adjustments in the length of the cable portion 39 between the eccentric pulleys 34 and 36 do not displace the rigid intermediate portions 58 and 60 from alignment with the sight window 20. Also the length of the linear sections 74 may be preselected to provide the required clearance for the arrow.

In a similar manner the length of the cable portion 39 between the pulleys 34 and 36 may be increased, as illustrated in FIG. 7, by advancing the bead 124A in a counterclockwise direction from root 120A to 120C. The corresponding adjustment is made to the opposite pulley with the total affect of permitting the limb end portions 26 and 28 to move further apart and increase the tension in the cable 38. By increasing the length of the cable portion 39 between the pulleys, the draw tension and the corresponding draw weight of the bow is increased. Thus with the above described arrangement of engaging the cable portion 39 to the pulleys 34 and 36, the draw length of cable portion 39 and the draw weight of the bow may be efficiently adjusted. Also by the alignment of the cable portions 39 and 43 with the longitudinal axis of the bow, the torque in the bow is eliminated for the selected tension of the cable.

According to the provisions of the Patent Statutes, I have explained the principle, preferred construction and mode of operation of my invention and have illustrated and described what I now consider to represent its best embodiments. However, it should be understood that, within the scope of the appended claims, the invention may be practiced otherwise than as specifically illustrated and described.

I claim:

1. A compound bow for propelling an arrow comprising, handle means for gripping the bow, a pair of limbs, each having a first end portion and a second end portion, said handle means connecting said first end portions of said pair of limbs, a rotatable member positioned adjacent to each of said limb second end portions, support means connected to said limb second end portions for rotatably supporting each of said rotatable members on said limb second end portions, cable means for flexing said pair of limbs, said cable means being reeved about said rotatable member on each of said limb second end portions, said cable means having a pair of end portions, harness means for connecting said cable means end portions to said respective support means, said harness means having a first end attached to said respective cable means end portion and a bifurcated second end, said bifurcated second end being positioned in surrounding relation with said respective rotatable member and secured to said support means, and locking means for releasably engaging said harness means bifurcated second end to said support means.

2. A compound bow for propelling an arrow comprising, handle means for gripping the bow, a pair of limbs, each having a first end portion and a second end portion said handle means connecting said first end portions of said pair of limbs a rotatable member positioned adjacent to each of said limb second end portions, support means connected to said limb second end portions for rotatably supporting each of said rotatable members on said limb second end portions, cable means for flexing said pair of limbs, said cable means being reeved about said rotatable member on each of said limb second end portions, said cable means having a pair of end portions, harness means for connecting said cable means end portions to said respective support means, said harness means having a first end attached to said respective cable means end portion and a bifurcated second end, said bifurcated second end being positioned in surrounding relation with said respective rotatable member and secured to said support means, said support means including a pair of aligned bores therethrough, said each of said rotatable members having a bore, a member extending through said support means aligned bores and said bore of said respective rotatable member, and said member having opposite end portions secured to said harness means bifurcated second end to maintain said respective cable means end portions and said respective rotatable member attached to said respective support means.

3. A compound bow for propelling an arrow comprising, handle means for gripping the bow, a pair of limbs, each having a first end portion and a second end portion, said handle means connecting said first end portions of said pair of limbs, a rotatable member positioned adjacent to each of said limb second end portions, support means connected to said limb second end portions for rotatably supporting each of said rotatable members on said limb second end portions, cable means for flexing said pair of limbs, said cable means being reeved about said rotatable member on each of said limb second end portions, said cable means having a pair of end portions, harness means for connecting said cable means end portions to said respective support means, said harness means having a first end attached to said respective cable means end portion and a bifurcated second end, said bifurcated second end being positioned in surrounding relation with said respective rotatable member and secured to said support means, said support means including an axle for rotatably supporting said rotatable member, said harness means bifurcated second end including a pair of aligned bores therethrough, said pair of aligned bores each having an enlarged diameter portion and a reduced diameter portion, said axle being arranged to pass freely through said enlarged diameter portion and prevented from passing through said reduced diameter portion, and said axle being retained in said reduced diameter portion by the tension exerted upon said harness means by said cable means to maintain said rotatable member on said axle.

4. A compound bow as set forth in claim 3 in which, said axle includes a shaft portion arranged to extend through said rotatable member and a pair of end portions arranged to be received within said aligned bores of said harness means bifurcated second end, a circumferential groove positioned on said axle between said shaft portion and each of said end portions, and said harness means bifurcated second end surrounding said bore reduced diameter portions arranged to engage said circumferential groove and prevent said axle from sliding through said aligned bores.

5. A compound bow for propelling an arrow comprising, handle means for gripping the bow, a pair of limbs, each having a first end portion and a second end portion, said handle means connecting said first end portions of said pair of limbs, a rotatable member positioned adjacent to each of said limb second end portions, support means connected to said limb second end portions for rotatably supporting each of said rotatable members on said limb second end portions, cable means for flexing said pair of limbs, said cable means being reeved about said rotatable member on each of said limb second end portions, said cable means having a pair of end portions, harness means for connecting said cable means end portions to said respective support means, said harness means having a first end attached to said respective cable means end portion and a bifurcated second end, said bifurcated second end being positioned in surrounding relation with said respective rotatable member and secured to said support means, said support means including a mounting bracket having a pair of arm members extending in spaced relation from each of said limb second end portions, said arm members having aligned bores therethrough, said harness means bifurcated second end being positioned in overlying relation with said arm members, said bifurcated second end having bores aligned with said arm members bores, and a member extending through said aligned bores for rotatably supporting said rotatable member between said arm members and said bifurcated second end and to connect said harness means to said mounting bracket.

6. A compound bow as set forth in claim 1 which includes, a hook on each of said cable end portions, and said harness means first end being slotted to receive said hook to removably connect said respective cable end portion to said harness means.

7. A compound bow comprising, a compound bow limb, a cable for flexing said compound bow limb, a bracket formed by a pair of arm members, said arm members each having a first end portion spaced from one another and a second end portion connected to one another, said arm member first end portions being connected to said compound bow limb, and said arm member second end portions being connected to an end portion of said cable and thereby connect said cable to said compound bow limb.

8. A compound bow as set forth in claim 7 which includes, a bracket mounted on said compound bow limb, a pin retained on said bracket, said arm member first end portions including a pair of aligned bores therethrough, said pair of aligned bores each having an enlarged diameter portion and a reduced diameter portion, and said pin being removably received in said enlarged diameter portion and said pin being nonremovably received in said reduced diameter portion to permit connection and disconnection of said harness to said compound bow limb.

9. A compound bow as set forth in claim 7 in which, said arm member second end portions having slotted means for releasably engaging said cable.

10. A compound bow for propelling an arrow comprising, handle means for gripping the bow, a first flexible limb and a second flexible limb connected to opposite ends of said handle means, said first and second limbs each having a free end portion, a first pulley and a second pulley, said first and second pulleys each including sprockets on the periphery thereof, mounting means for rotatably positioning said first and second pulleys on said free end portions of said first and second limbs respectively, cable means extending between said limbs free end portions for flexing said pair of limbs to place said limbs in tension, said cable means having a pair of end portions attached to said mounting means respectively and having portions reeved about said first and second pulleys to extend said cable between first and second pulleys and apply a preselected draw tension on said cable, a plurality of engaging devices secured to said cable means and positioned in spaced relation on said portions of said cable means reeved about said first and second pulleys, selected ones of said engaging devices being engageable with said sprockets of said first and second pulleys to position said free end portions of said limbs a preselected distance apart, and said cable means having a preselected length extending between said first and second pulleys as determined by the distance between said free end portions of said limbs to apply a preselected draw tension to said cable means.

11. A compound bow as set forth in claim 10 which includes, means for eccentrically positioning said first and second pulleys on said mounting means.

12. Compound bow apparatus comprising, a compound bow limb, a cable for flexing said compound bow limb, a pulley having a body portion and a rim portion, said body portion having a bore therethrough to facilitate mounting said pulley on said compound bow limb, said rim portion having an outer peripheral edge extending around said rim portion, a plurality of sprocket teeth positioned on said peripheral edge, said cable being reeved about said pulley, and selected ones of said sprocket teeth being adaptable to engage said cable to exert a preselected tension thereon.

13. Apparatus as set forth in claim 12 in which, said plurality of sprocket teeth are equally spaced from one another on said peripheral edge.

14. Apparatus as set forth in claim 12 in which, said sprocket teeth each are formed by a first set of sprocket teeth and a second set of sprocket teeth on said peripheral edge, said first and second sets of sprocket teeth being oppositely positioned and spaced apart by a plurality of annular grooves on said peripheral edge, and said sprocket teeth of said first and second sets being equally spaced from one another to form roots separating adjacent teeth of each set on said peripheral edge.

15. Apparatus as set forth in claim 12 in which, said pulley body portion has a geometric center, and said bore being eccentrically off-set from said geometric center.

16. Compound bow apparatus comprising, a pair of flexible limbs, handle means for connecting said pair of limbs, each of said flexible limbs including a free end portion, a flexible cable extending under tension between said free end portions and including a first end portion and a second end portion, a plurality of adjustment devices secured to said cable and positioned in spaced relation on said cable first and second end portions, selected ones of said adjustment devices being engageable with said compound bow free end portions to flex said limbs and position said free end portions a preselected distance apart, and said cable having a preselected length extending between said free end portions as determined by the engagement of said adjustment devices with said free end portions to apply a preselected tension on said cable corresponding to a preselected draw weight and draw length of said cable.

17. Compound bow apparatus as set forth in claim 16 in which, said adjustment devices include a plurality of beads secured in spaced relation on said cable first and second end portions.

18. Compound bow apparatus as set forth in claim 16 which includes, a pair of overlying cable rigid sections positioned between said pair of cable end portions, said pair of overlying cable rigid sections extending along a longitudinal axis, and said pair of overlying cable rigid sections each having an intermediate portion deflected laterally from said longitudinal axis.

19. Compound bow apparatus as set forth in claim 18 in which, said pair of overlying cable rigid sections each have a first end portion connected to said respective cable end portions and a second end portion, said first and second end portions of said rigid sections being aligned with said longitudinal axis, said intermediate portions extending between said first and second end portions respectively, and said intermediate portions being laterally displaced from said first and second end portions.

20. Apparatus as set forth in claim 19 in which, said intermediate portions each include a first linear section connected to and extending at an angle from said first end portion and a second linear section connected to and extending at an angle from said second end portion, said intermediate portions each having a third linear section connecting said first and second linear sections, and said third linear section being positioned in spaced lateral relation and parallel to said first and second end portions.

21. Apparatus as set forth in claim 20 in which, said third linear sections of said intermediate portions respectively are positioned in overlying relation when said cable is in an undrawn position, and said third linear sections being positioned in spaced relation when said cable is in a drawn position.

22. Apparatus as set forth in claim 18 in which, said intermediate portions of said pair of overlying rigid sections are positioned in overlying relation.

* * * * *